US006983741B2

(12) United States Patent
Donald

(10) Patent No.: US 6,983,741 B2
(45) Date of Patent: Jan. 10, 2006

(54) PITCHING MACHINE

(76) Inventor: Brashier Donald, 1855 E. 29th St., Signal Hill, CA (US) 90755

( * ) Notice: Subject to any disclaimer, the term of this patent is extended or adjusted under 35 U.S.C. 154(b) by 41 days.

(21) Appl. No.: 10/846,985

(22) Filed: May 14, 2004

(65) Prior Publication Data

US 2005/0252498 A1 Nov. 17, 2005

(51) Int. Cl.
*F41B 4/00* (2006.01)

(52) U.S. Cl. ..... 124/6

(58) Field of Classification Search ..... 124/6, 124/78

See application file for complete search history.

(56) References Cited

U.S. PATENT DOCUMENTS 4,323,048 A * 4/1982 Saito et al. ..... 124/78
4,325,351 A * 4/1982 Yuasa ..... 124/78
4,442,823 A * 4/1984 Floyd et al. ..... 124/78
4,760,835 A * 8/1988 Paulson et al. ..... 124/78
5,437,261 A * 8/1995 Paulson et al. ..... 124/78
5,865,161 A * 2/1999 Bruce ..... 124/78
6,164,271 A * 12/2000 Paulson et al. ..... 124/78
6,443,140 B1 * 9/2002 Crews et al. ..... 124/78
6,488,020 B1 * 12/2002 Rosas-Magallan ..... 124/78
6,732,724 B1 * 5/2004 Paulson et al. ..... 124/6

* cited by examiner

*Primary Examiner*—John A. Ricci
(74) *Attorney, Agent, or Firm*—Marcia A. Devon

(57) ABSTRACT

An adjustable pitching machine is disclosed which generates a rise ball, or a drop ball, or a curve, or a slider, or a forkball, or a fastball, or other suitable pitches, or to produce a ground ball with or without topspin or side spin, or a fly ball with or without topspin, or side spin for fielding and fly ball practice. The pitching machine may also pitch tennis balls without topspin or sidespin to a tennis player during practice. The pitching machine may include a shield to prevent the hitter, or fielder or tennis player from observing the settings of the pitching machine and preparing for the next pitch prior to pitch delivery.

14 Claims, 7 Drawing Sheets

PITCHING MACHINE

BACKGROUND OF THE INVENTION

1. Field of Invention

The present invention relates generally to the field of automatic ball pitching machines.

2. Background Information

Pitching machines may be employed to train baseball, softball and tennis players. Pitching machines automatically deliver a baseball or softball to a batter. Some pitching machines may be adjusted to produce ground balls and fly balls for fielding and fly ball practice. Some pitching machines may be adjusted to produce a rise ball, a drop ball, a curve, a slider, a fastball or a limited combination of these pitches, but not all of these pitches. Other pitching machines may send tennis balls to a tennis player during practice. With many pitching machines, the hitter, fielder, or tennis player can observe the settings or layout of the pitching machine prior to pitch delivery and determine the type of pitch prior to delivery and use this foreknowledge to prepare for the pitch. It is preferable for the batter not to know which type of pitch is coming thereby better simulating an actual baseball game. Some prior machines produce pitches which cannot be predicted in advance of the pitch. As a result, the batter must step out of the batter's box so that a test pitch is made e.g. to insure that the batter is not hit by the ball. The batter therefore clearly knows the type of pitch in advance. When a player is training to field balls, it is impossible for the human pitcher to repeatedly throw the ball in a precise location. In contrast, the present invention can be set produce a pitch which is delivered to a precise location in a predetermined manner for the fielder to practice catching. There is no known prior pitching machine which has can produce all of the above-mentioned pitches, balls for fielding, which also trains tennis players, and which prevents the user from observing the settings.

A pitching machine is therefore needed which may be adjusted to pitch a rise ball, a drop ball, a curve, a slider, a forkball, a fastball, or other suitable pitches. A pitching machine which can produce a ground ball, with or without topspin or side spin, a fly ball with or without topspin or side spin, for fielding and fly ball practice is advantageous. Further, it is desirable to have a pitching machine that may also pitch tennis balls, with or without topspin or sidespin, to a tennis player during practice. The pitching machine should have a means to prevent the hitter, fielder or tennis player from observing the settings of the pitching machine and prepare for the next pitch prior to pitch delivery.

SUMMARY OF THE INVENTION

It is an object of the present invention to provide a pitching machine which may be adjusted to create a variety of pitches: a rise ball, a drop ball, a curve, a slider, a forkball, a fastball, and other suitable pitches, as well as producing a ground ball and a fly ball for fielding and fly ball practice. It is an object of the present invention to provide a pitching machine which will repeatedly produce the same pitch based on the settings made by the user. It is a further object of the present invention to have a pitching machine which may pitch tennis balls to a tennis player during practice. The pitching machine of the present invention is designed to prevent the user from observing the settings of the pitching machine and preparing for the next pitch prior to pitch delivery.

The ball pitching machine of the present invention includes a tube having a long axis, a first end and an opening in the tube parallel to the long axis. The ball pitching machine also includes an axle and an axle support. The axle support is attached to the tube perpendicularly to the axle and the long axis. The pitching machine further includes a drive wheel which is enclosed by a housing. The drive wheel is mounted on the axle and the bottom of the housing is placed over the opening in the tube. The pitching machine also includes a shield for blocking the view of the user. The shield has a hole located in the center of the shield for receiving the end of the tube along the perimeter of the hole. The drive wheel is rotated on the axle so that the drive wheel can impart spin on the ball as it moves through the tube.

These and other features and advantages of this invention will become further apparent from the detailed description and accompanying figures that follow. In the figures and description, numerals indicate the various features of the invention, with the same numerals referring to same features throughout both the drawings and description.

DETAILED DESCRIPTION

Figure 1:
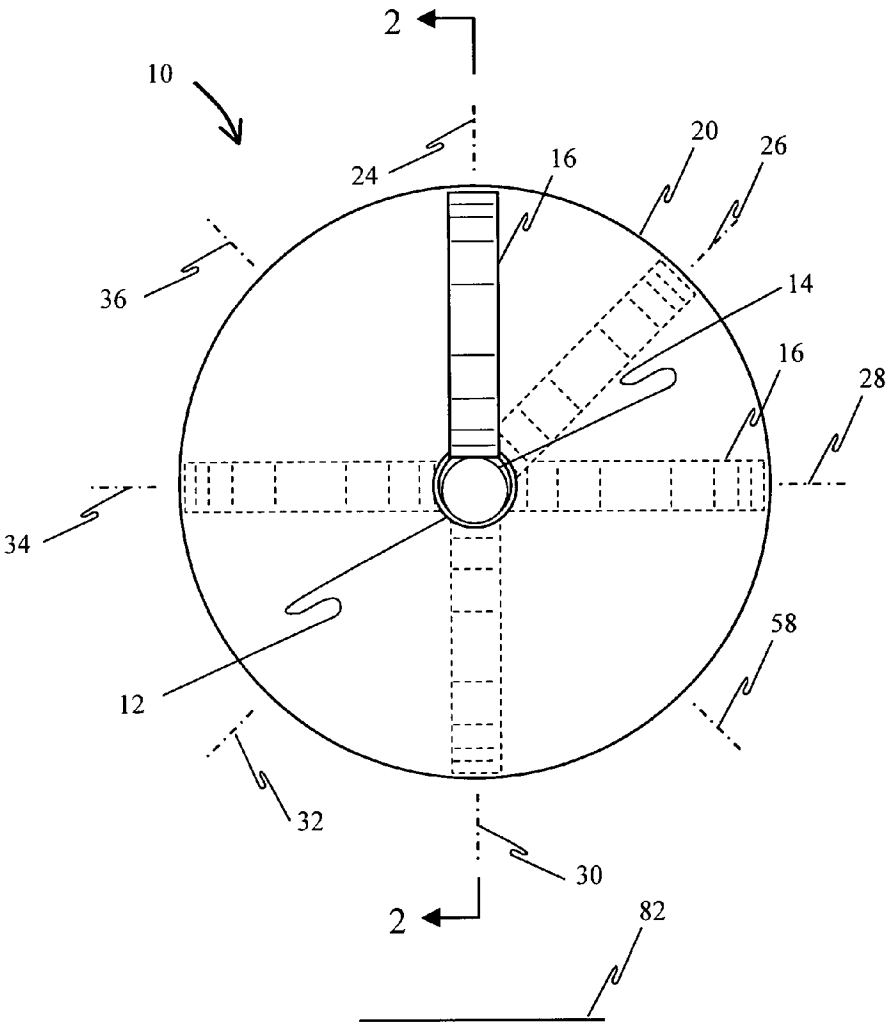
FIG. 1 is a rear view of a ball pitching machine according to the present disclosure.
Figure 3:
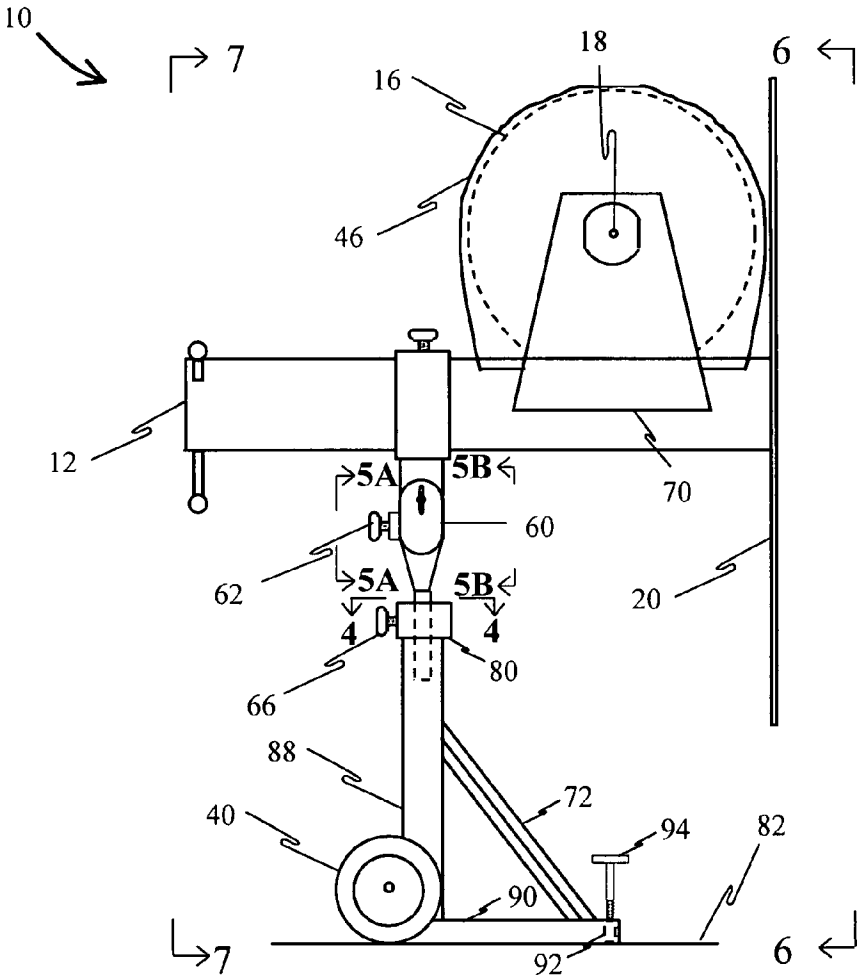
FIG. 3 is a side view of a ball pitching machine according to another embodiment of the present disclosure.

The pitching machine 10 is shown in FIG. 3. A ball 14 is placed into the tube 12 by the user through tube 12 until the ball is engaged by drive wheel 16, as shown in FIG. 1. The spinning drive wheel 16 creates suction which pulls the ball forward through the tube. When the drive wheel 16 contacts the ball 14, the ball is propelled out of the tube 12. The angle of the drive wheel relative to tube 12 and ground 82 determines the type of pitch thrown by the pitching machine 10. The drive wheel angles may be selected by the user to create different types of pitches and range from zero to 360 degrees. For example, different drive wheel angles are shown in FIG. 1: a zero degree angle 24, 45-degree angle 26, 90-degree angle 28, or 135-degree angle 58, or 180-degree angle 30, or 225-degree angle 32, or 270-degree angle 34, or 315-degree angle 36. The following is a table of the settings to form the various pitches:

| Type of Pitch | Drive Wheel Angles shown in FIG. 1 |
|---|---|
| Drop ball | 26–36 (between 315° & 45°) |
| Fast ball | 24 (0°) |
| Curve ball | 26–28 (between 45° & 90°) |
| Rise ball | 58–32 (between 135° & 225°) |
| Slider or screw ball | 34–36 (between 270° & 360°) |

The drop ball has top spin and the fast ball has back spin.

The drive wheel 16 angles cannot be seen by the batter when pitching machine 10 is viewed from the side opposite a shield 20. The shield 20 prevents a user from viewing the angle of drive wheel 16 and determining the type of pitch prior to delivery.

Figure 2:
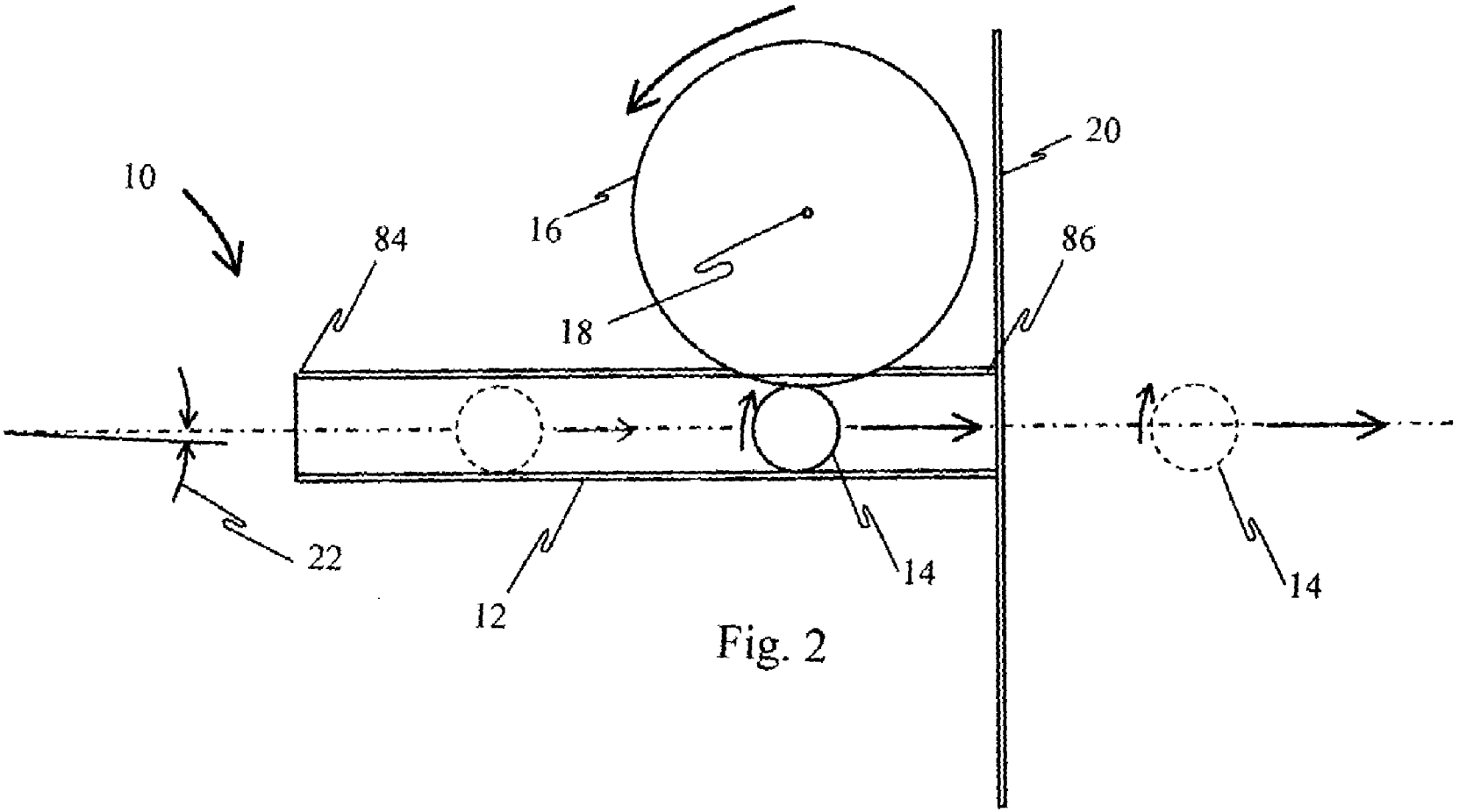
FIG. 2 is a cross sectional view of the ball pitching machine of FIG. 1.

Referring to FIG. 2, the ball 14 enters the tube 12 through the aft end 84. The drive wheel 16 rotates on the axel 18. A protective cover 46 encloses the drive wheel 16 as shown in FIG. 3. The cover 46 is attached to the tube over an opening in tube 12 (not shown). The axel support 70 is also affixed to the tube 12. Drive wheel 16 rotationally engages ball 14 inducing a rotation into ball 14 and propelling it past the forward end 86 and out of the tube 12. The rotational speed of drive wheel 16 may be varied so that a pitched ball may leave forward end 86 at speeds up to and exceeding 65 miles per hour. Ball speeds of 110 mph for baseball and even faster ball speeds may be achieved by using a larger wheel and a smaller tube. The tube 12 may be elevated or pointed downward by angle 22 relative to ground 82, as shown in FIG. 2. The tube is typically set downward to create ground balls. The tube may be elevated slightly to aim at the high portion of the strike zone or the lower portion of the strike zone, as well as to create particular types of pitches. The angle 22 may be 2 to 3 degrees for a rise ball and zero degrees for a fast ball. The elevation of tube 12, the drive wheel speed and drive wheel 16 angle are all factors in creating the type of pitch. The tube elevation is set such that the tube pivots around 62 by loosening screw 42.

The pitching machine may be portable and mounted on a stand 88 with wheels. FIG. 3 shows the tube, axle, axle support, and the drive wheel mounted to a stand 88. The stand 88 includes a brace 72, a leg 90,a fastener 94 and a collar 80 attached at the top of the stand 88. The wheel 40 is rotationally connected to stand 88. An axle or other suitable means may connect the drive wheel 40 to the stand 88. The wheel 40 is located on stand 88 so that pitching machine 10 can be tilted back onto the wheel 40 and relocated on the ground 82. Fastener 94 may be attached to ground 82 by fitting fastener 94 through a hole 92 in leg 90. Fastener 94 is threaded or may have any suitable configuration. Fastener 94 may be screwed into ground 82 to secure the machine in place. The hole 92 may be threaded or may have another suitable configuration. The axel 18 is connected to tube 12 by axle support 70. The stand 88, leg 90, brace 72 and fastener 94 may be fabricated from metal or other suitable material. The wheel 40 may be fabricated from metal, or plastic, or rubber or other suitable material.

Figure 4:
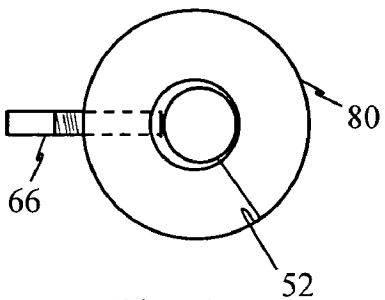
FIG. 4 is a section cut view of the ball pitching machine of FIG. 3.

The tube 12 may also be positioned horizontally from side to side as well as vertically up and down. The tube is positioned horizontally by loosening screw 66 as shown in FIG. 3 and FIG. 4. Referring to FIG. 4, a clevis 52 is attached to tube 12 and pivots in collar 80. A screw 66 is inserted through a threaded hole in collar 80 to clamp the clevis 52 to collar 80 thereby preventing the clevis 52 from pivoting in collar 80. The clevis 52, collar 80 and screw 66 may be fabricated from metal or other suitable material.

Figures 5A, 5B, 5C, 5D:
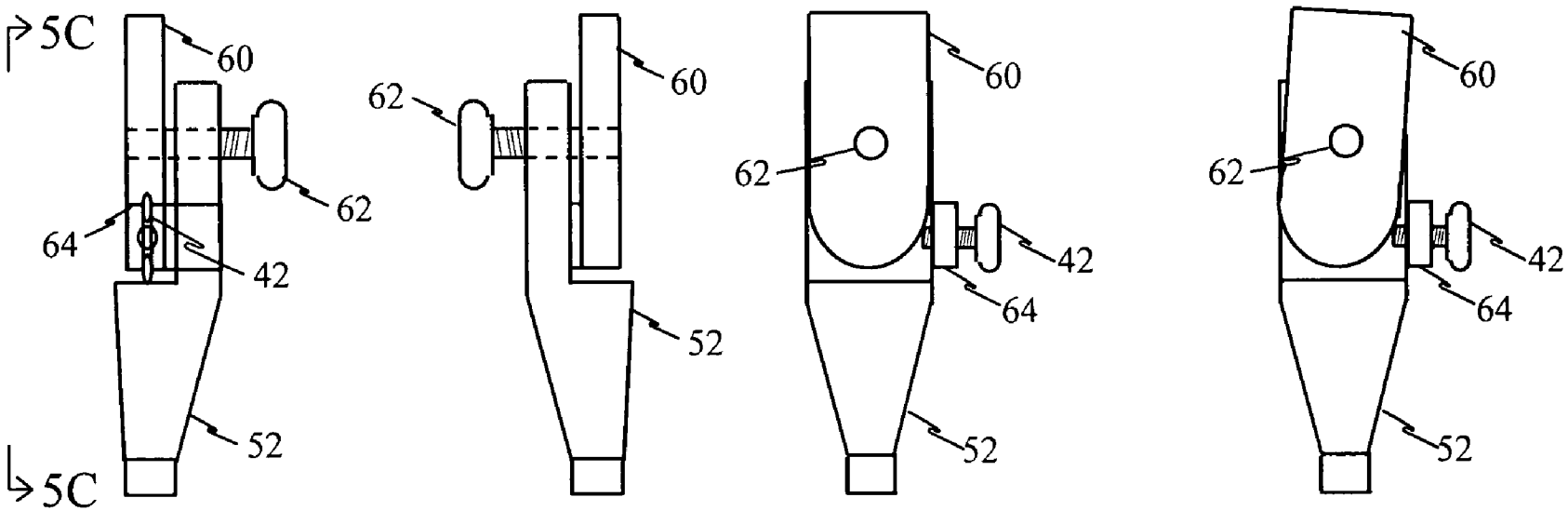
FIG. 5A is a rear view of the connection between clevis 52 and clevis 60 of FIG. 3.
FIG. 5B is a front view of the connection between clevis 52 and clevis 60 of FIG. 3.
FIG. 5C is a side view of the connection between clevis 52 and clevis 60 of FIG. 5A.
FIG. 5D is a side view of the connection between clevis 52 and clevis 60 of FIG. 5A with clevis 60 pivoted relative to clevis 52.

FIGS. 5A, 5B, 5C and 5D, shows how the tube, axel and axel support is interconnected to the stand. A clevis 52 is pivotably connected by pin 62 to a clevis 60. The clevis 60 is connected to the tube 12. The block 64 is connected to the clevis 52. A screw 42 is inserted through a threaded hole in the block 64 and impinges upon the clevis 60. Extension or retraction of screw 42 as shown in FIGS. 5C and 5D, adjusts the pivoting of the clevis 60 about pin 62 and therefore the elevation of the tube 12. The clevis 60, the pin 62, the block 64 and the screw 42 may be fabricated from metal or other suitable material.

Figure 6:
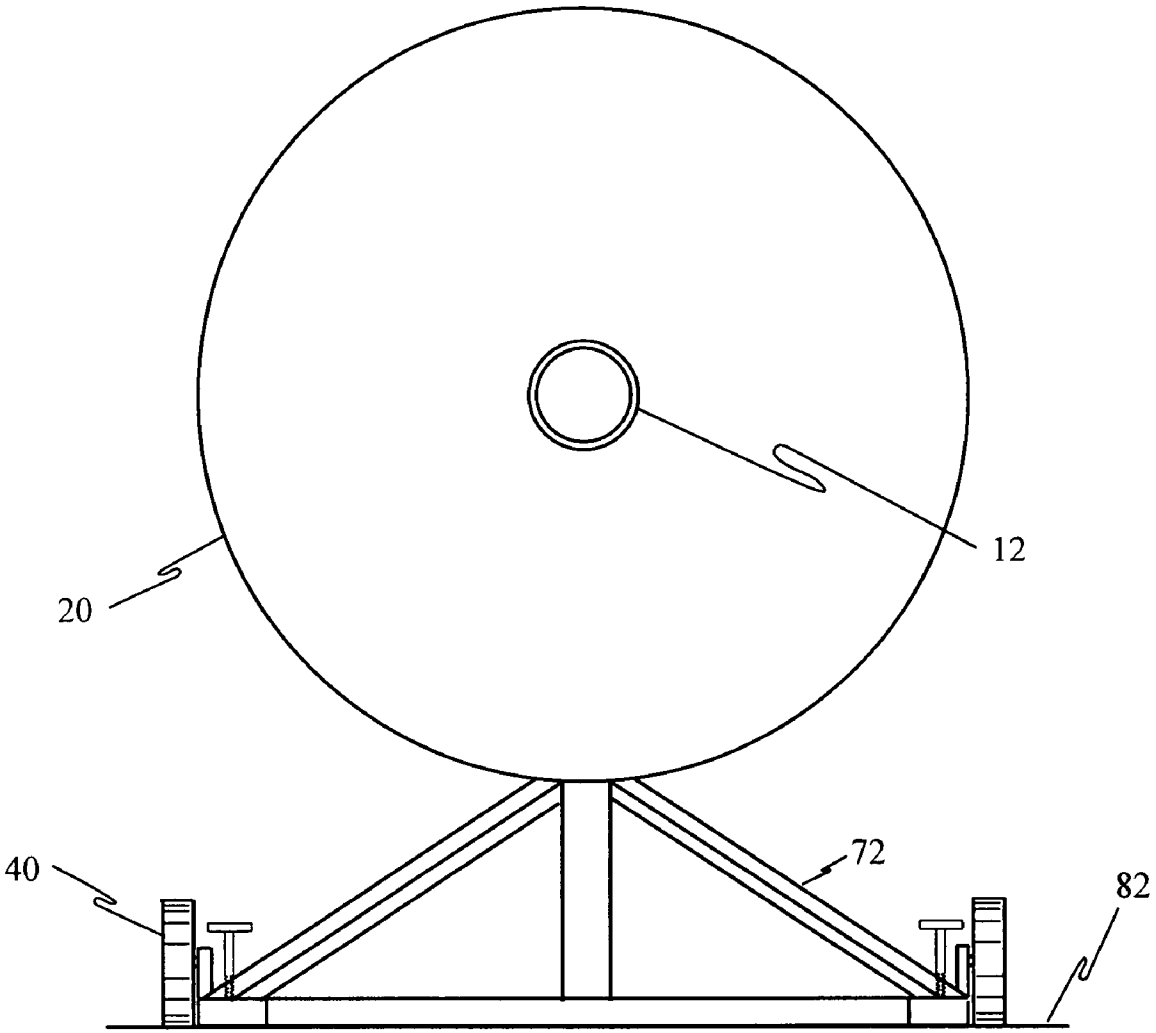
FIG. 6 is a front view of the ball pitching machine of FIG. 3.

The drive wheel angle cannot be seen when pitching machine 10 is viewed from the side opposite shield 20, as shown in FIG. 6. A user may not be able to view the angle of the drive wheel 16 behind shield 20 and prevent the user from determining the type of pitch prior to delivery. The batter must react to the pitch after it leaves the tube 12. The shield 20 may be fabricated from metal, including aluminum, hardened steel, plastic or other suitable material. The drive wheel 16 may be fabricated from metal, or plastic, or rubber or other suitable material.

Figure 7:
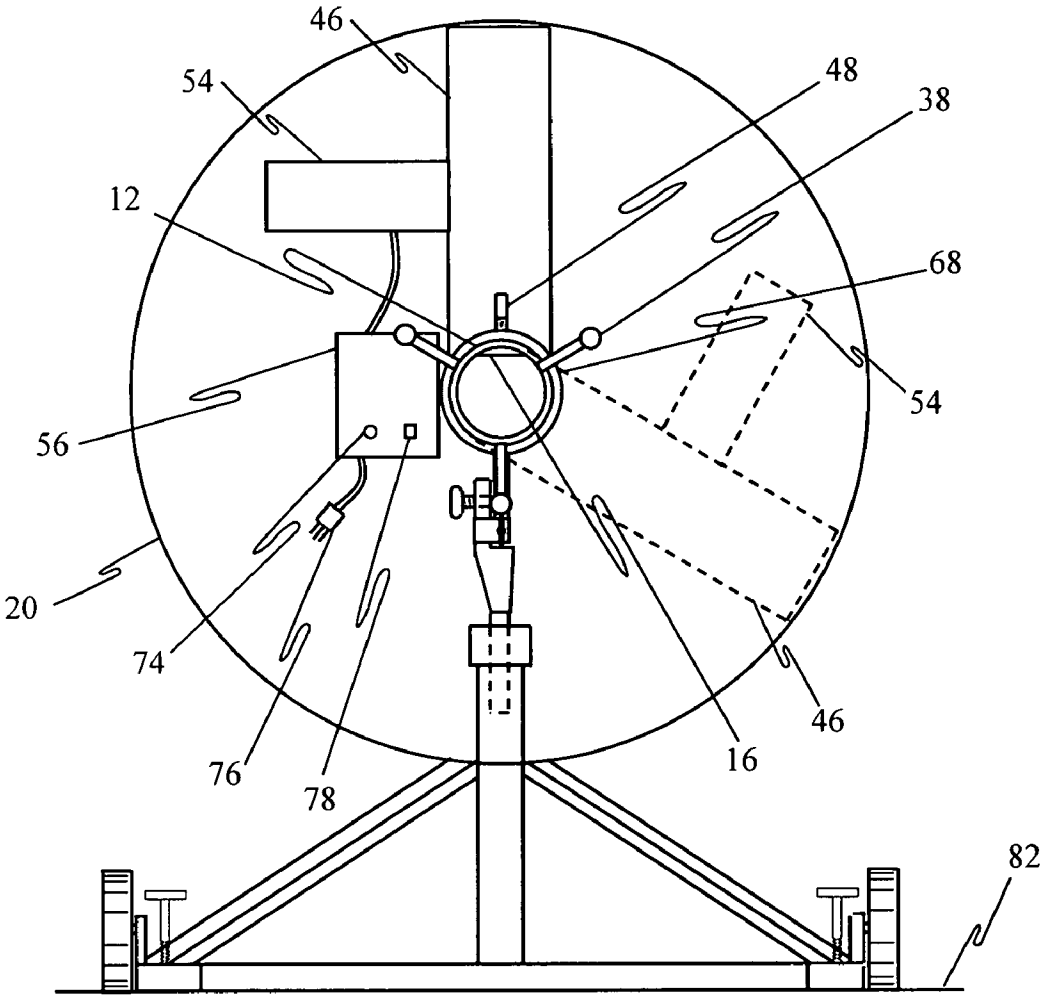
FIG. 7 is a section cut view of the ball pitching machine of FIG. 3.

Referring now to FIG. 7, the clevis 60 is attached to a sleeve 68. The tube 12 is slideably fitted through sleeve 68 permitting rotation to produce drive wheel 16 angles from zero to 360 degrees. A screw or pin 48 is inserted through a threaded hole in the sleeve 68 to clamp the tube 12 to sleeve 68 thereby locking tube 12 and drive wheel 16 in place at an angle from zero to 360 during operation. Slots may be placed at predetermined locations in the sleeve 68 to lock the pin 48 (and therefore the drive wheel) into position at particular angles. The handles 38 further facilitate rotation of tube 12 in sleeve 68. The shield 20 may be fabricated from metal, or plastic, or rubber or other suitable material.

The motor 54 is attached to cover 46 and rotationally propels drive wheel 16. The motor 54 may be rotationally connected to drive wheel 16 by belts and pulleys, chains and sprockets or directly to axle 18 or other suitable means. The motor 54 may be an AC or DC electric motor, a generator, an internal combustion motor or any other suitable motor. The motor 54 is electrically connected to the control box 56. The control box 56 includes a switch 78 and speed controller 74. The switch 78 turns the motor 54 on or off. In a preferred embodiment, the speed controller 74 is a conventional electronic controller of the rotational speed of the DC motor 54. The speed of the motor is selected with switches on the controller 74.

Figure 8:
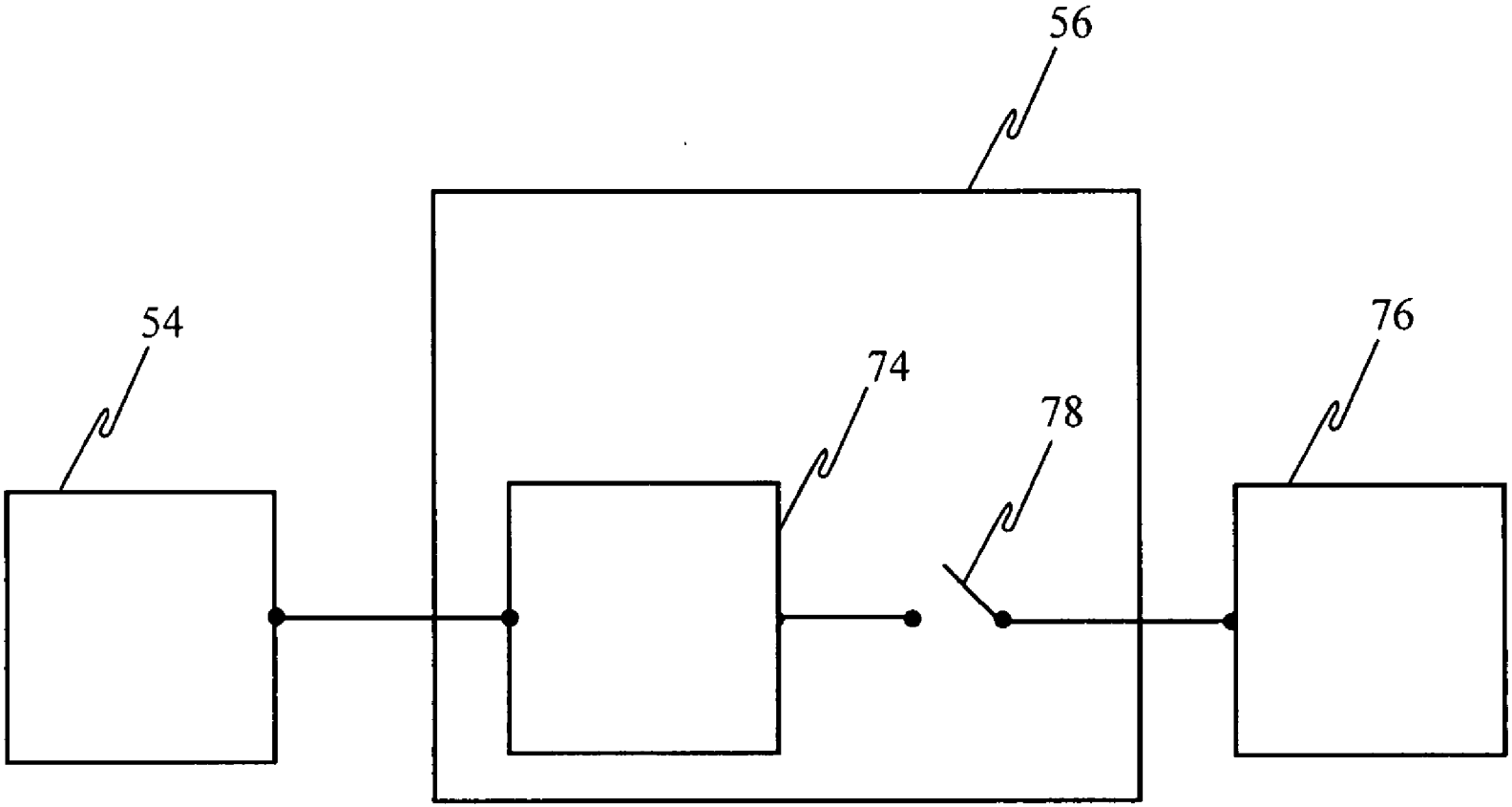
FIG. 8 is a block diagram of the control mechanism for motor 54.

With reference to FIG. 8, power enters control box 56 when connector 76 is connected to a suitable power supply and when switch 78 is in the closed position.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims and their equivalents.

What is claimed is:

1. A ball pitching machine comprising:

an axle;

an axle support connected the axle;

a drive wheel mounted on said axle for rotating around said axle, said drive wheel having an outer perimeter;

a tube for receiving the ball, said tube having a long axis, a first end and a slot parallel to the long axis wherein a portion of said outer perimeter is located in the slot of said tube; and a means for rotating the drive wheel around said axle and setting said drive wheel at any selected angle between zero and three-hundred and sixty degrees around said long axis.

2. The ball pitching machine of claim 1 further including a means for elevating or lowering said tube relative to said long axis.

3. The ball pitching machine according to claim 1 further including: a shield having a hole concentrically located in the center, the first end of the tube concentrically attached perpendicularly to the shield around the perimeter of the hole.

4. The ball pitching machine of claim 1 wherein the means for rotating the drive wheel on the axle is a motor rotationally connected to the drive wheel.

5. The ball pitching machine according to claim 4 further including a motor controller.

6. The ball pitching machine according to claim 5 wherein said controller varies the speed of the motor.

7. The ball pitching machine according to claim 1 further comprising a stand attached to the tube.

8. The ball pitching machine according to claim 7 wherein the stand having a base with at least one wheel.

9. The ball pitching machine according to claim 7 wherein the stand having a base with a means for fastening the stand to the ground.

10. The ball pitching machine according to claim 7 wherein the stand having a means for horizontally swiveling the tube.

11. The ball pitching machine according to claim 7 wherein the stand includes a means for pivoting the tube vertically about an axis parallel to the axle.

12. The ball pitching machine according to claim 1 wherein the tube includes handles.

13. A ball pitching machine comprising:

an axle;

an axle support connected the axle;

a drive wheel mounted on said axle for rotating around said axle, said drive wheel having an outer perimeter;

a tube for receiving the ball, said tube having a long axis, a first end and a slot parallel to the long axis wherein a portion of said outer perimeter is located in the slot of said tube; and a motor connected to the drive wheel around said axle; and means for setting said drive wheel at any selected angle between zero and three-hundred and sixty degrees around said long axis.

14. The pitching machine of claim 13 wherein said means for setting the drive wheel angle comprises a sleeve and a removable pin.

* * * * *